United States Patent [19]

Nakamura

[11] 4,047,459

[45] Sept. 13, 1977

[54] VALVE TUNING SYSTEM FOR THE BRASS MUSICAL INSTRUMENTS

[76] Inventor: Satoshi Nakamura, 556 Oaza Hakoda, Kumagaya, Saitama, Japan

[21] Appl. No.: 603,177

[22] Filed: Aug. 8, 1975

[51] Int. Cl.[2] ..... G10D 9/04

[52] U.S. Cl. ..... 84/390

[58] Field of Search ..... 84/388–394

[56] References Cited

U.S. PATENT DOCUMENTS

| | | | |
|---|---|---|---|
| 12,628 | 4/1855 | Hammer | 84/390 |
| 1,222,285 | 4/1917 | Hamblen | 84/389 |
| 1,244,745 | 10/1917 | King | 84/390 |
| 1,642,783 | 9/1927 | Lehmann | 84/394 |
| 2,003,995 | 6/1935 | Einhorn | 84/392 |
| 2,288,743 | 7/1942 | Reed | 84/395 |
| 2,794,358 | 6/1957 | Meredith | 84/388 |
| 3,175,449 | 3/1965 | Kravka | 84/390 |
| 3,641,863 | 2/1972 | Kanstul et al. | 84/390 |

FOREIGN PATENT DOCUMENTS

| | | | |
|---|---|---|---|
| 315,507 | 3/1919 | Germany | 84/390 |

*Primary Examiner*—Lawrence R. Franklin
*Attorney, Agent, or Firm*—Berman, Aisenberg & Platt

[57] ABSTRACT

A valve tuning system for a brass musical instrument having a single valve housing, a single valve body, which may be in several parts, a basic pipe and a plurality of by-pass pipes connected to the housing. A plurality of air-pipes or passages are formed in the valve body and a plurality of tuning keys are operable to move the valve body to a plurality of switch-over positions such that various combinations, or all, of the air-pipes and by-pass pipes may be connected in series with the basic instrument pipe to yield a temperament ratio without significant aberrations.

12 Claims, 31 Drawing Figures

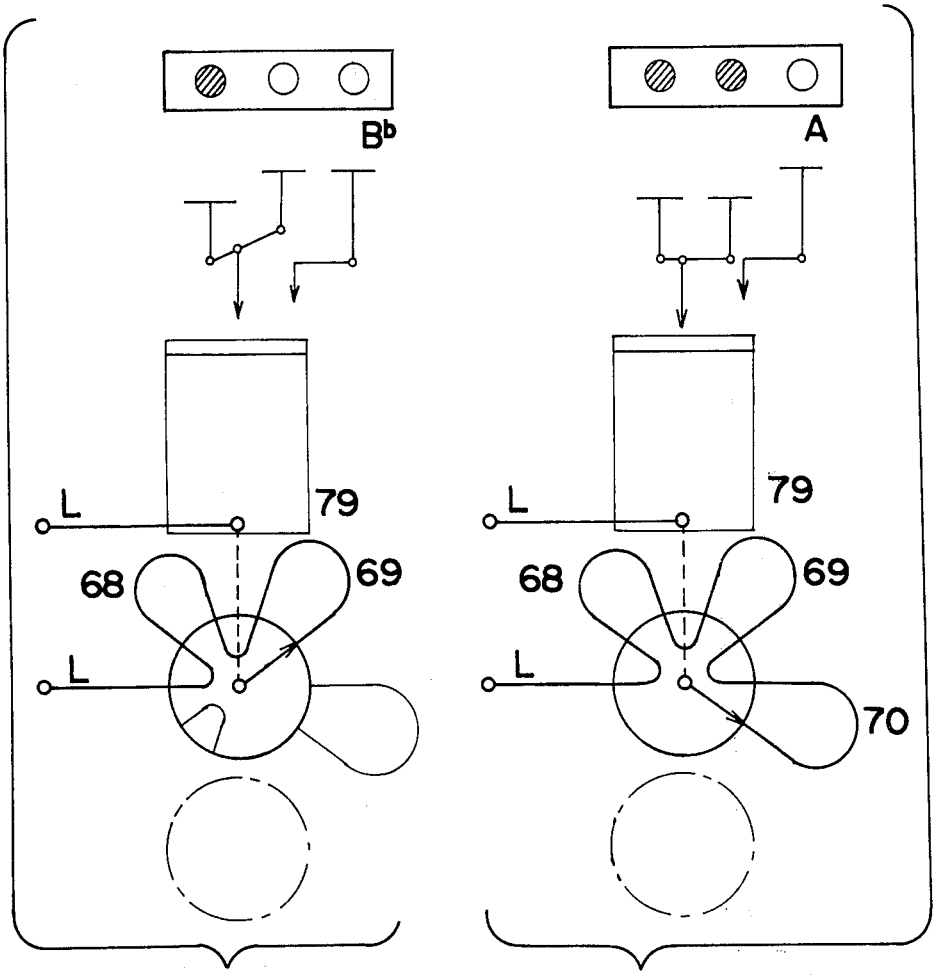
FIG.8—3 FIG.8—4

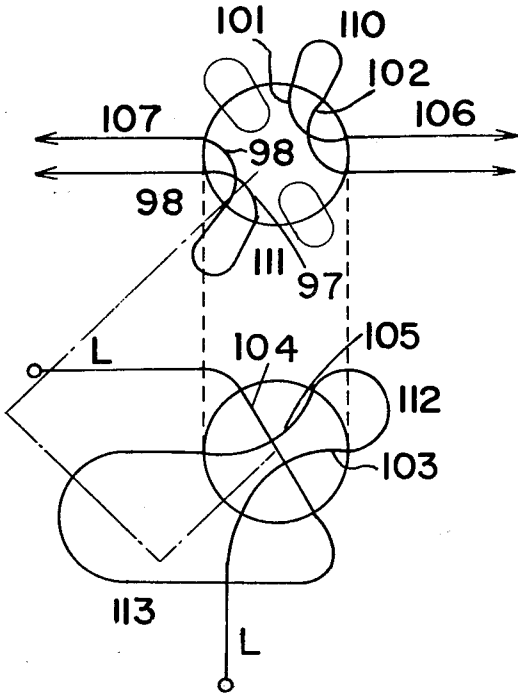
FIG. 14—2
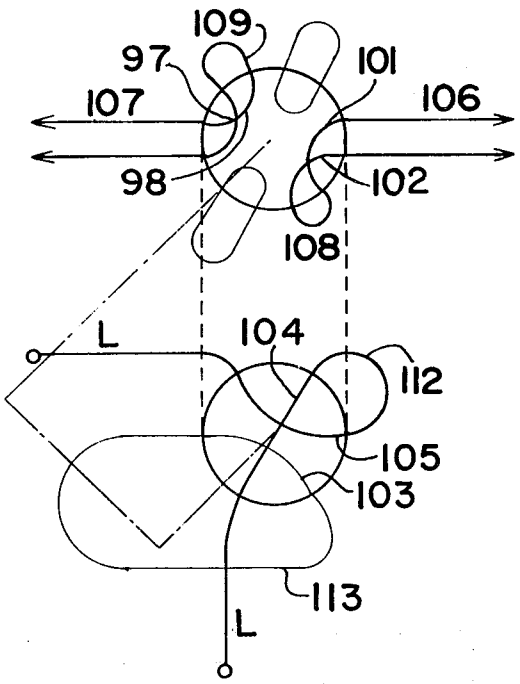
FIG. 14—1

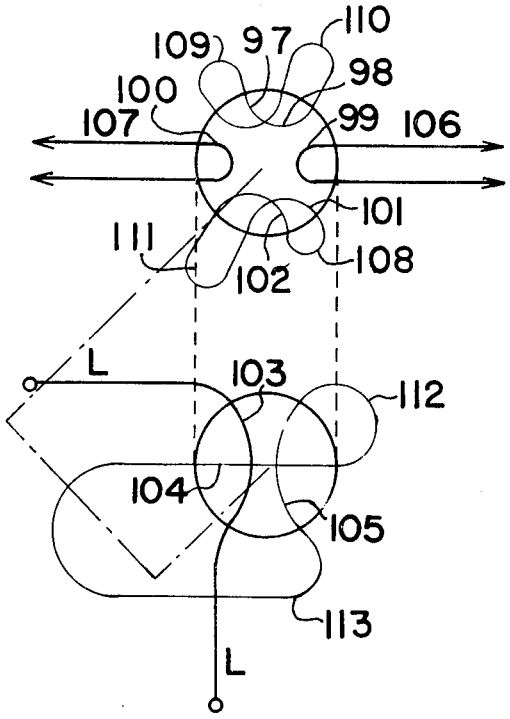
FIG.14 — 3

VALVE TUNING SYSTEM FOR THE BRASS MUSICAL INSTRUMENTS

BACKGROUND OF THE INVENTION

1. Field of the Invention

This invention relates to a valve system for brass musical instruments, and, to a valve system in which a single valve is utilized to switchover more than one by-pass pipe independently to connect with the basic pipe of the instrument.

2. Description of the Prior Art

Conventional valve systems for brass musical instruments employ a valve mechanism composed of three or four separate valves placed in the basic pipe L between the mouthpiece and the bell, each of which valves is equipped with its own by-pass pipe and each of which has its own operation or tuning key so that each valve key when pressed switches to connect its own by-pass pipe to the basic pipe of the instrument.

In such conventional systems, supposing the basic pipe L is 1000 units long, most commonly the first by-pass pipe $l_1$ controlled by the second valve is about 59 units long, which lowers the tone about a semi-tone when the pipe $l_1$ is added to L; the second by-pass pipe or loop $l_2$ controlled by the first valve is about 122 units long which lowers the tone about two semi-tones when it is added to L; the third by-pass circuit $l_3$ controlled by the third valve is about 189 units long which lowers the tone about three semi-tones lower when it is added to L; and the fourth by-pass loop $l_4$ controlled by the fourth valve in a four valve device is about 335 long which lowers the tone of the instrument about five semi-tones when it is added to L.

When the valve operating, or tuning keys are pushed certain by-pass pipes are combined by the switchover of the valves, and a tone scale of seven semi-tones from C to G♭ can be obtained as described in following Table 1, where three valves are used.

Table 1

| tuning key pattern | tone name | by-pass circuit | ratio of the real length of the whole by-pass circuit | temperament ratio | aberration |
|---|---|---|---|---|---|
| O O O | C | (L) | 1000 | 1000 | |
| O ● O | B | $l_1$ | 1059 | 1059 | 0 |
| ● O O | B♭ | $l_2$ | 1122 | 1122 | 0 |
| ● ● O<br>O O ● | A | $l_1$, $l_2$<br>$l_3$ | 1181<br>1189 | 1189<br>1189 | 8<br>0 |
| O ● ● | A♭ | $l_3$, $l_1$ | 1248 | 1260 | 12 |
| ● O ● | G | $l_3$, $l_2$ | 1311 | 1335 | 24 |
| ● ● ● | G♭ | $l_3$, $l_1$, $l_2$ | 1370 | 1414 | 44 |

A scale consisting of 12 semi-tones from C to D♭ can be obtained when four valves are employed. These scales, however, do not necessarily coincide with the 12 temperament scale which is desired and the more by-pass pipes are combined, the larger the aberration from temperature becomes.

These aberrations arise from the difference between the real length of the whole pipe composed of the basic pipe L and some by-pass pipes and the ideal length of pipe, or temperament ratio, required for each pitch.

To avoid these aberrations, many improvements have been suggested, or used, such as making the real length of the pipe, including added by-pass pipes, correspond to the ideal length by increasing the number of valves, and by increasing the number of by-pass pipes to be added to the basic pipes, or by using a U-type trigger device together with appropriate fingering of tuning keys. But these alleged improvements are accompanied by disadvantages such as enlargement of the device as a whole and complications in playing the instruments. The bigger a brass instrument is, the greater these defects are.

SUMMARY OF THE INVENTION

The present invention has the important purpose of reducing the number of valves to as small a number as possible because individual valves are difficult and expensive to manufacture. Another important purpose is to make the real length of the entire pipe circuit combined by the valve device such as to equal the ideal pipe length, thereby eliminating the above briefly described defects of existing conventional devices, and without changing the present fingering pattern of the tuning keys. In other words, the invention permits a brass instrument to be equipped with a single multi-switchable valve such that the real lengths of the pipe circuits combined with one another equal the ideal ratios of the pipe lengths, the one valve serving to switch more than one by-pass pipe independently.

BRIEF DESCRIPTION OF THE DRAWINGS

A better understanding of this invention and the objects and features thereof may be had by reference to the accompanying drawings, in which:

FIGS. 4-1 to 4-7 are the schematic diagrams showing fingering operations and resulting combinations of by-pass pipes in various stages of rotation of the valve of FIG. 1;

FIG. 5 is a front elevation partially in section of a second valve embodiment according to the invention;

FIG. 6 is a sectional plan view of the upper portion of the valve taken on line A–A′ in FIG. 5;

FIG. 7 is a sectional plan view of the lower portion of the valve taken on line B–B′ in FIG. 5;

FIGS. 8-1 to 8-8 are schematic diagrams showing fingering operation and resulting combinations of by-pass pipes in various stages of rotation of the valve of FIG. 5;

FIGS. 11-1 to 11-3 are schematic diagrams showing the resulting combinations of by-pass pipes in various stages of rotation of the valve of FIG. 9;

Figure 12:
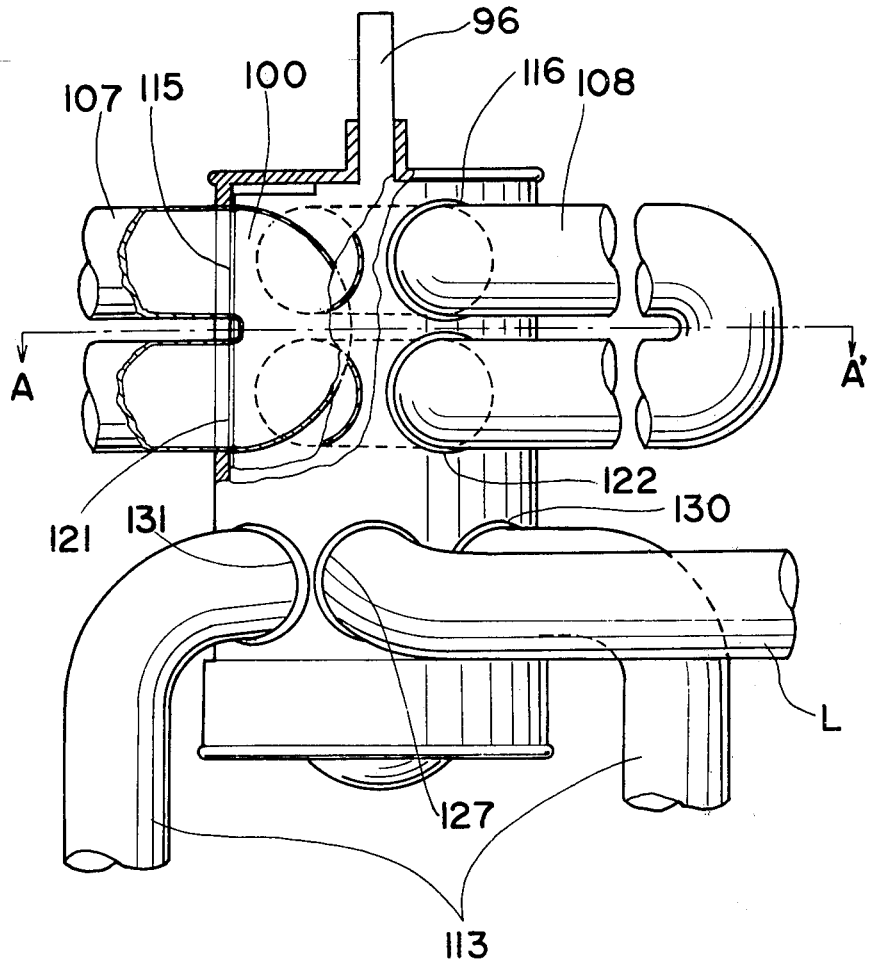
FIG. 12 is a front elevation partially in section of a fourth rotary valve embodiment according to the invention.

FIGS. from 14-1 to 14-3 are the schematic diagrams showing the resulting combination of by-pass pipes in various stages of rotation of the valve of FIG. 12;

DESCRIPTION OF THE PREFERRED EMBODIMENTS

The invention will be explained in detail with respect to the illustrated four embodiments which, however, do not limit the invention, other applications and embodiments being possible.

The drawings from 1 through 4–7 illustrate example 1 which utilizes a single rotary valve with six by-pass pipes connected to the wall of the valve housing. Six air passages or air-pipes corresponding to the mentioned by-pass pipes pass through the valve rotor, and a seventh air-pipe forms a part of the basic instrument pipe L.

Figure 1:
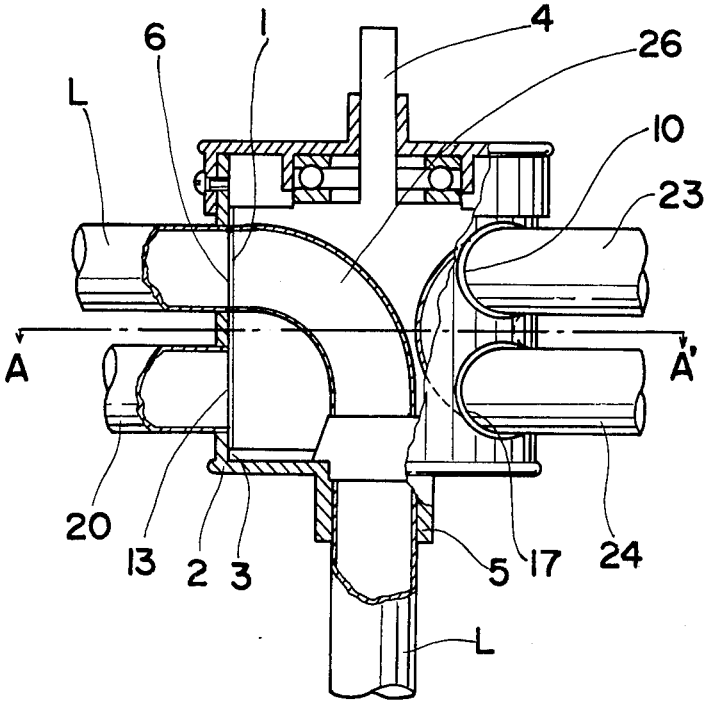
FIG. 1 is a front elevation partially in section of a rotary valve employed in the invention.
Figure 2:
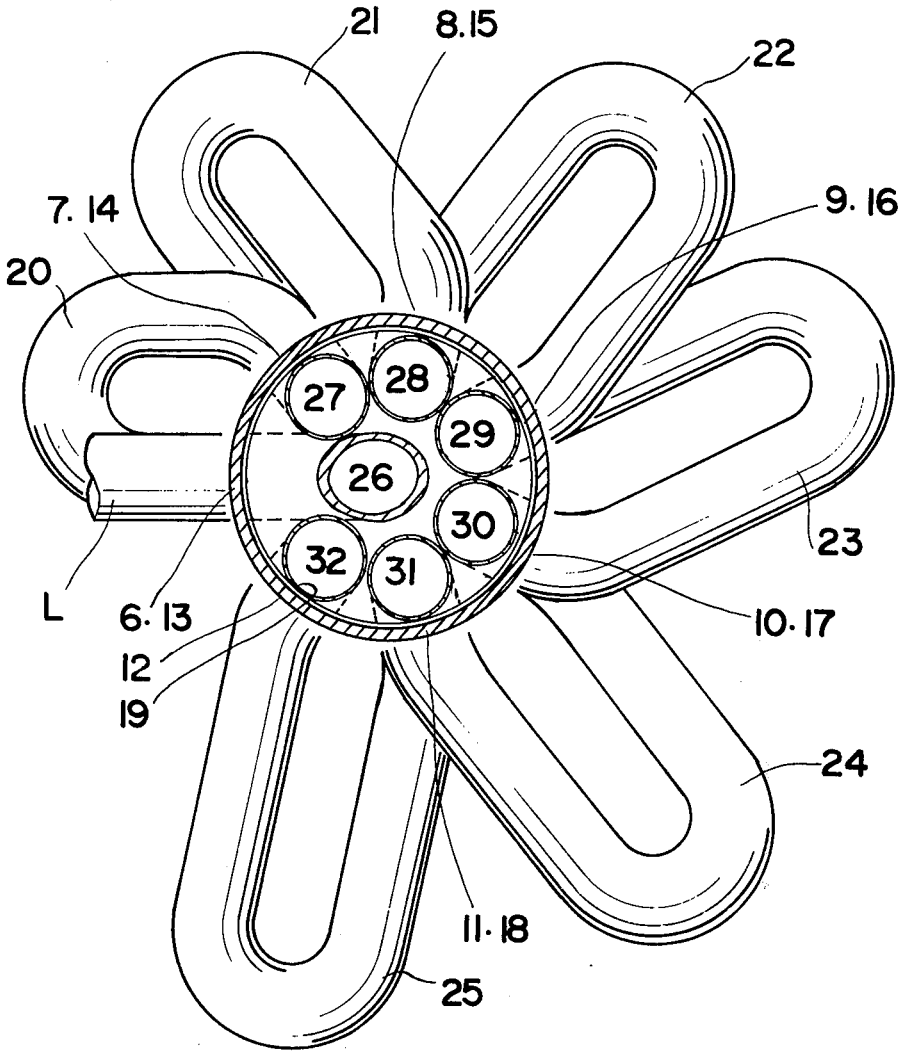
FIG. 2 is a section plan view of the same rotary valve taken on line A–A′ of FIG. 1.

In FIG. 1 reference 1 designates the rotor inside the valve housing; 2 designates the valve housing side wall; 3 designates a plastic gasket or packing; 4 the rotor shaft; 5 the outward valve housing vent of the basic pipe L led out under the rotor 1; and 2 the valve housing bottom wall. The references 6, 7, 8, 9, 10, 11 and 12 designate the upper vents formed on the rotor and the valve cylindrical side wall; 14, 15, 16, 17 and 18 represent the lower vents formed on the rotor and the valve side wall. The rotor is equipped with one additional lower vent 19 and the housing side wall is equipped with one more lower vent 13. The seven upper vents, on both rotor and housing, are placed on the same level at right angles to the axis of the rotor and the valve side wall, the rotor being switched to connect the vents every 360°/M of angled rotation. The lower vents are similarly placed on the same level. The instrument basic pipe L and the by-pass pipes 20, 21, 22, 23, 24, and 25 are attached to the vents on the housing side wall. Namely: as seen in FIG. 2, pipe L is attached to vent 6 on the valve side wall; the by-pass pipe 20 is attached to the vents 7 and 13; the by-pass pipe 21 is attached to vents 8 and 14; pipe 22 is attached to vents 9 and 15; by-pass pipe 23 is attached to vents 10 and 16, pipe 24 is attached to vents 11 and 17; and pipe 25 is attached to vents 12 and 18.

Similarly, inside of the rotor the passage or air-pipe 26 forming a part of the basic pipe L and the six air-pipes 27, 28, 29, 30, 31 and 32 forming a part of the by-pass circuit are connected to the rotor vents. In detail: and as viewed in FIG. 1 and FIG. 2, to the vents 5 and 6 the air-pipe 26 forming a part of the basic pipe L is connected; to the vents 7 and 14 the air-pipe 27 is connected; the air-pipe 28 is connected to the vents 8 and 15; the air-pipe 29 is connected to vents 9 and 16; air-pipe 30 is connected to vents 10 and 17; air-pipe 31 is connected to vents 11 and 18; and air-pipe 32 is connected to vents 12 and 19.

Figure 3:
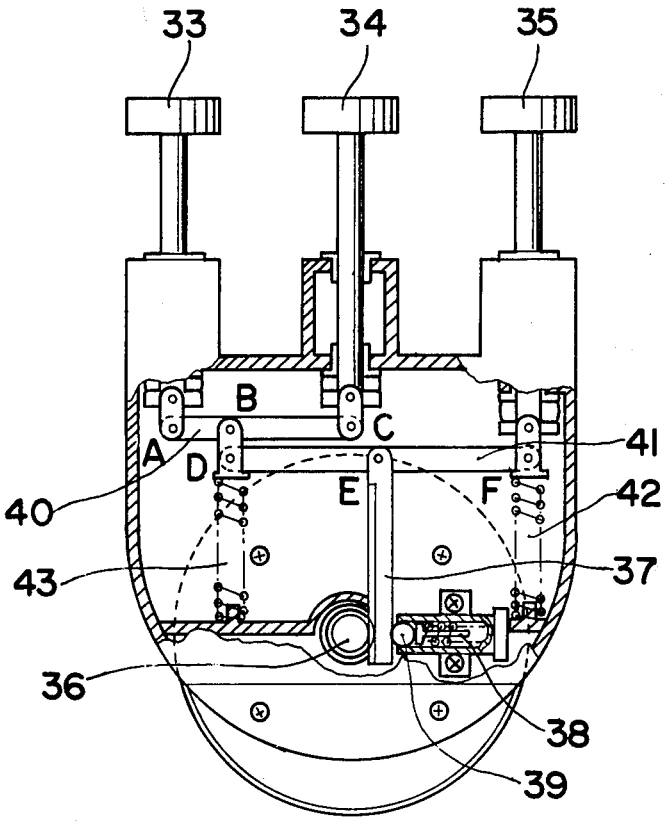
FIG. 3 is a front elevation partially in section of the fingering equalizer mechanism of the valve of FIG. 1.

FIG. 3 shows the fingering keys and connected equalizer mechanism to rotate the rotary valve. Parts 33, 34 and 35 designate the tuning or tone keys; 36 designates the valve rotor shaft; 37 designates the arm which serves to rotate the valve rotor shaft 36; 38 is a spring which adjusts the arm 37 so that it contacts the rotor shaft with adequate frictional force; 39 is a Teflon ball; 40 and 41 designate crossheads or links which serve to transmit movements of the tuning keys 33, 34 and 35 to the arm 37; and 42 and 43 are shock-absorbing springs for the crossheads.

The crossheads 40 and 41 are so made that BC, DE and EF are respectively each two, three and three units long supposing AB is one unit long. This enables the movements of the tuning keys 33, 34, and 35 to be divided into six categories and the valve to be switched to six different positions.

The air-pipes of the rotor, 27, 28, 29, 30, 31 and 32 forming parts of the by-pass pipes, can be different in length but in this example, they are the same length, i.e., 22 units long when the basic pipe L is 1,000 units long. The by-pass pipes 20, 21, 22, 23, 24 and 25 are respectively made 37, 41, 45, 49, 53 and 57 units long when the basic pipe L is 1,000 units long.

Figures 1, 4:
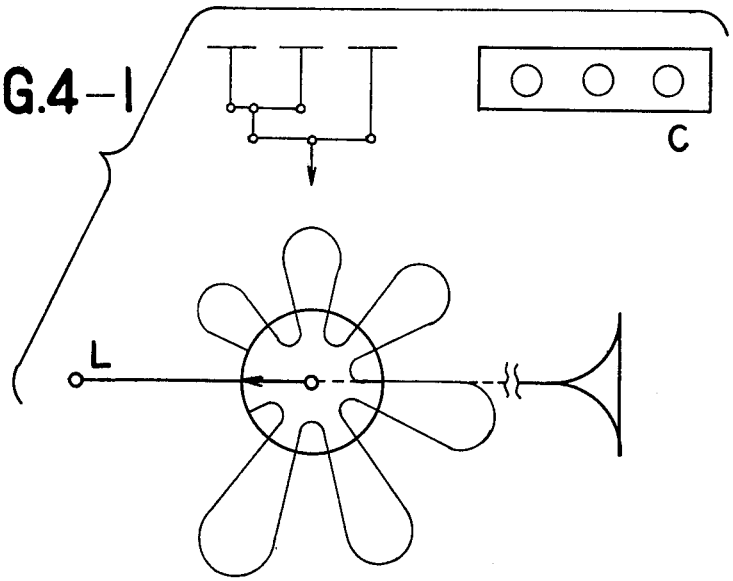
Figures 2, 4:
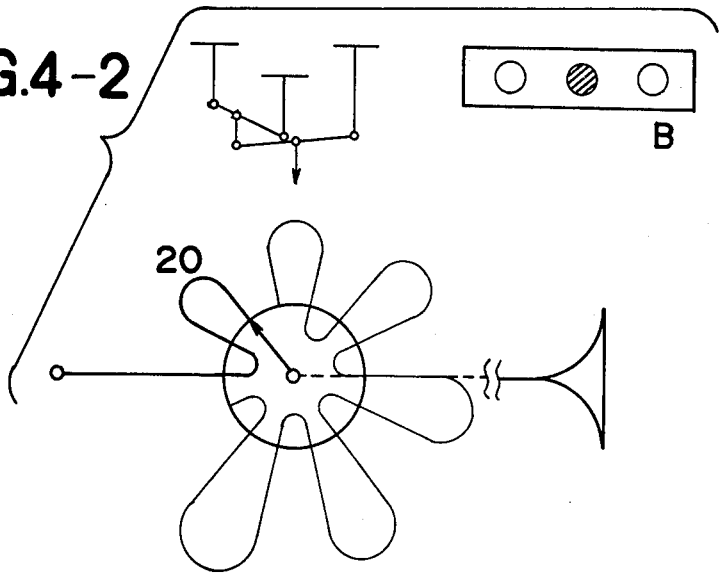
Figures 3, 4:
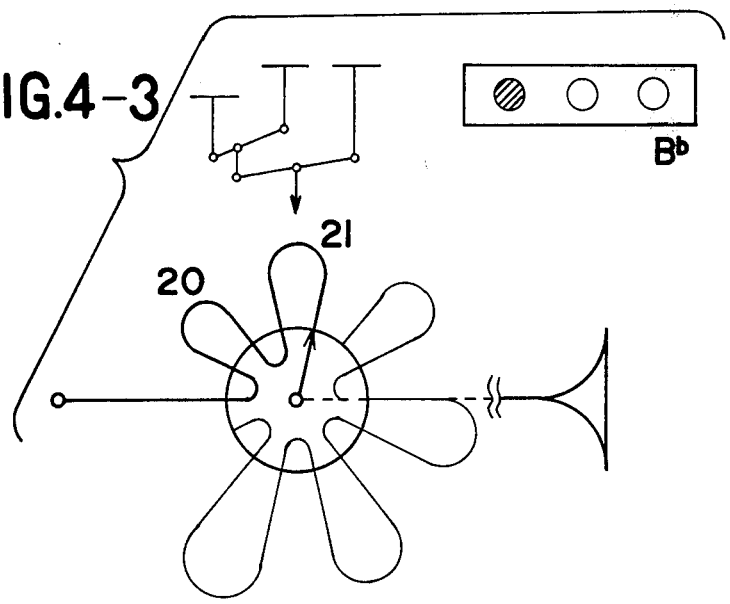
Figure 4:
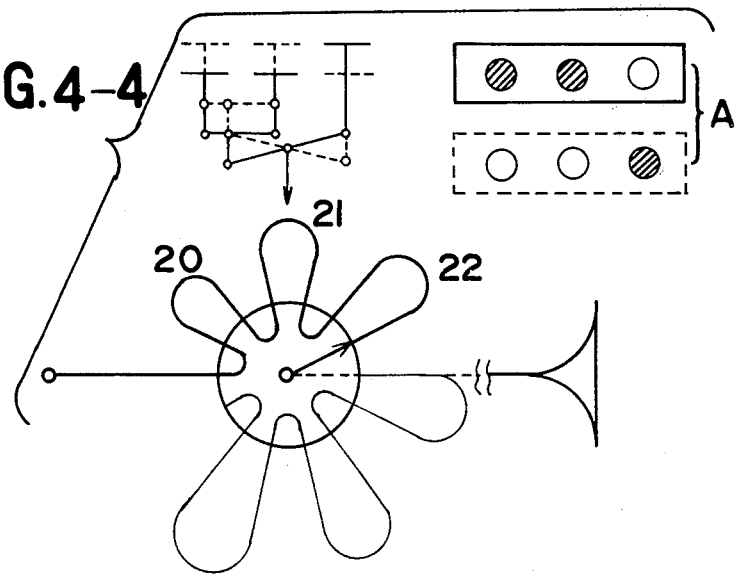

In this example, in the case of [O O O] pattern, all keys 33, 34, 35 are up, and air will pass only through the basic pipe L as illustrated in FIG. 4-1 to provide a C tone. In the case of [O • O] pattern when the tuning key 34 is pushed with the second finger and the valve is rotated by 360°/7, B tone is attained by the air as illustrated in FIG. 4-2. Similarly as illustrated in the FIGS. 4-3 to 4-7, the tones B♭, A, A♭, G and G♭ can be gained by pushing the tuning keys 33, 34 and 35 in the manner illustrated in each figure. The seven semi-tones obtained in this way are shown in following Table 2. It should be here noted that the air-pipes in the valve rotor are vertically disposed while the by-pass pipes are angled to connect to offset upper and lower vents in the valve. Thus when the valve keys are fingered to step the rotor around, the air pipes serve to connect the by-pass pipes in series with one another and the basic pipe L. It should be further noted that the valve is so constructed as to control the inclusion of six by-pass pipes and seven air-pipes in the rotor by fingering merely three keys, each of the by-pass and air-pipes being much shorter than corresponding by-pass pipes of conventional instruments.

Table 2

| tuning key pattern | tone name | by-pass circuit | ratio of the real length of the whole by-pass circuit | temperament ratio | aberration |
|---|---|---|---|---|---|
| O O O | C | (L) | 1000 | 1000 | |
| O ● O | B | 26,20,32 | 1059 | 1059 | 0 |
| ● O O | B♭ | 26,21,32 20,31 | 1122 | 1122 | 0 |
| ● ● O / O O ● | A | 26,22,32, 21,31,20, 30 | 1189 | 1189 | 0 |
| O ● ● | A♭ | 26,23,32, 22,31,21, 30,20,29 | 1260 | 1260 | 0 |
| ● O ● | G | 26,24,32 23,31,22, 30,21,29, 20,28 | 1335 | 1335 | 0 |
| ● ● ● | G♭ | 26,25,32, 24,31,23, 30,22,29, 21,28,20, 27 | 1414 | 1414 | 0 |

The defect of a conventional system that the longer the by-pass circuit is, the more greatly its length deviates from the ideal length of temperament as in the case shown in Table 1, is not present in the example shown in Table 2. Not only the ratio of real length coincides with that of the temperament but also when the invention is applied to a trombone, the characteristic peculiar to the slide trombone can be brought into full play by successive operation of the tuning keys even though the trombone utilizes a fingered valve device.

The FIGS. 5 to 8-8 illustrate example 2 in which this invention is applied by use of a valve similar to the rotary valve employed in example 1.

Figures 4, 5:
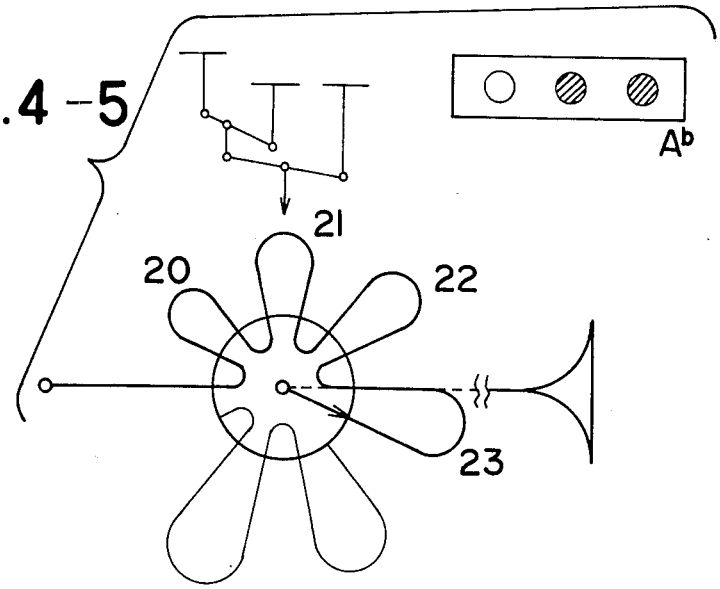
Figures 4, 5, 6:
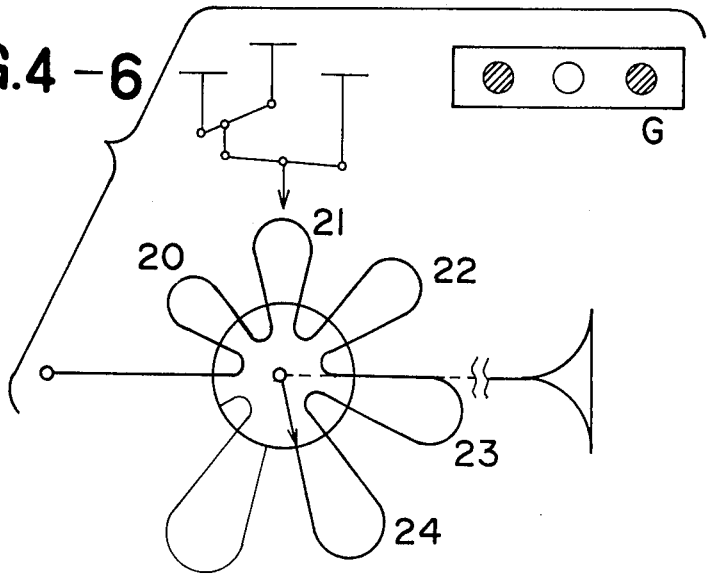
Figures 4, 5, 6, 7:
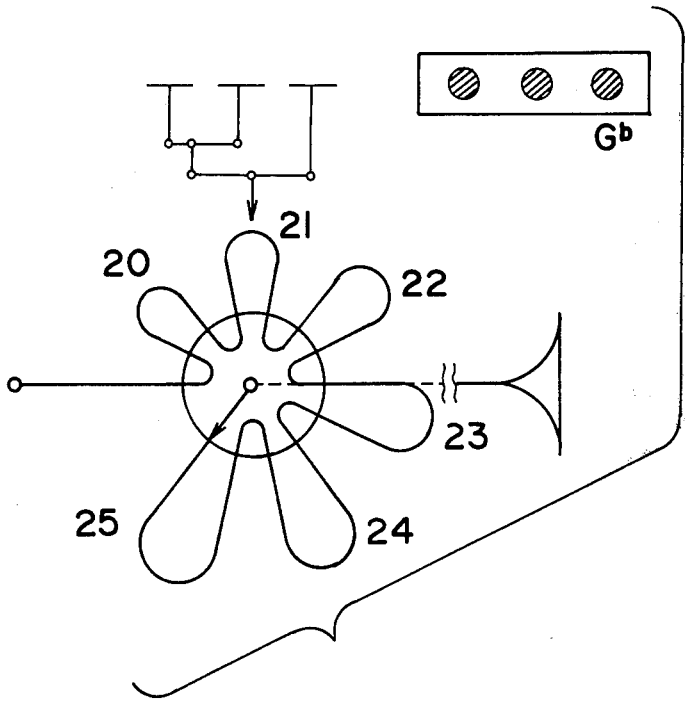
Figure 5:
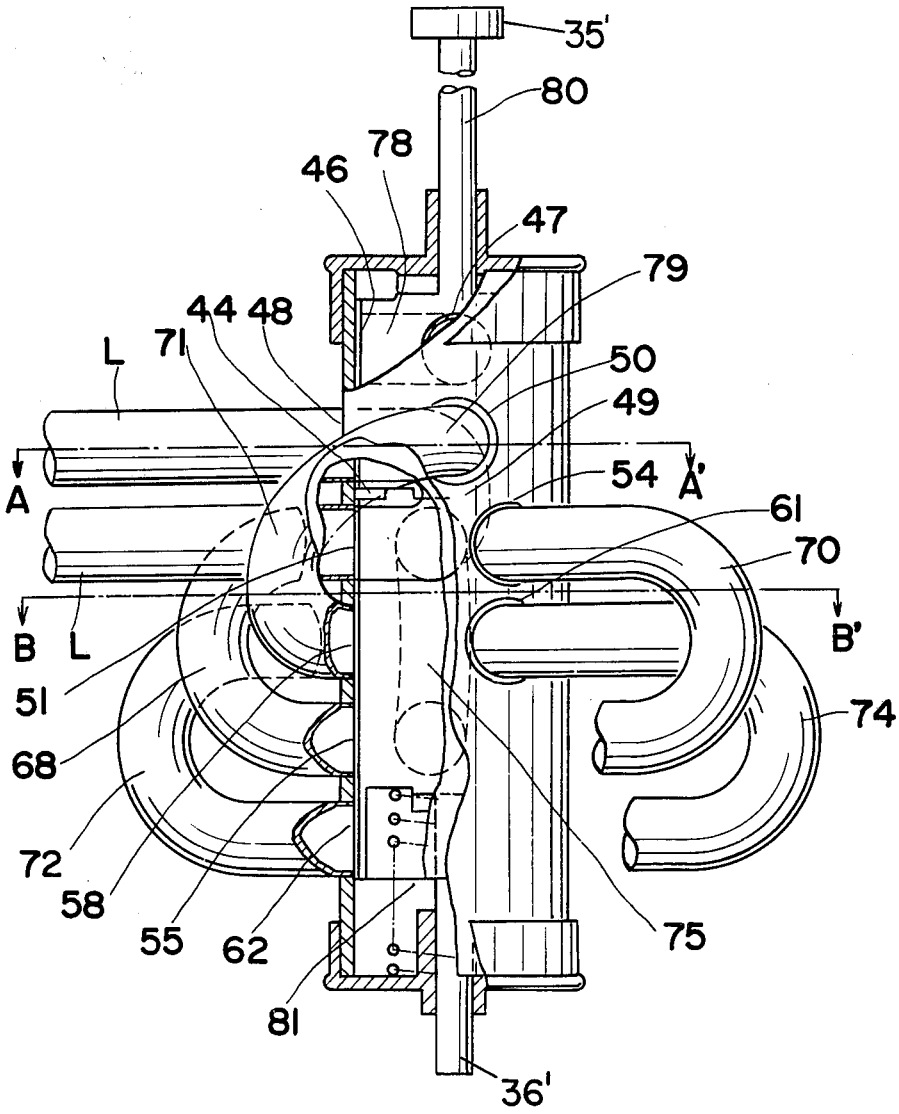
Figure 6:
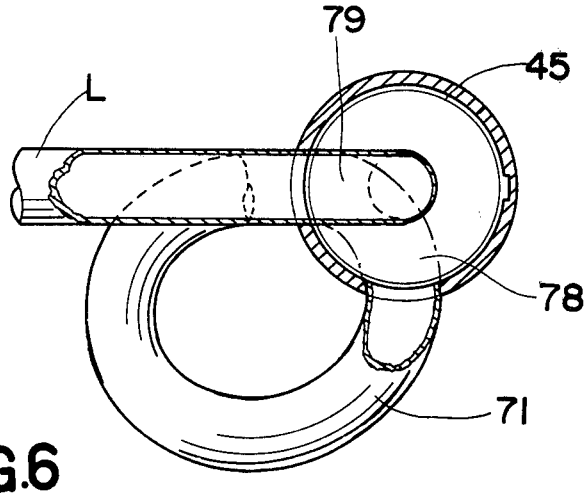
Figure 7:
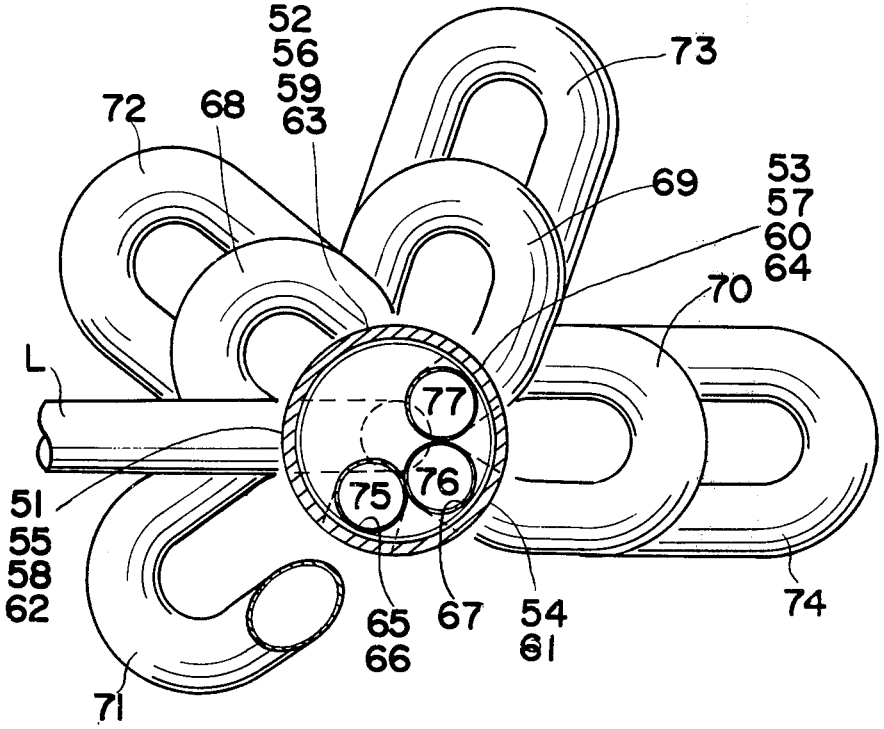

The valve employed in example 2 is illustrated in FIGS. 5, 6 and 7. The said valve is roughly divided into an upper piston part, a lower rotary part and a coupling part 44.

The upper piston part 45 has a vent 49 in its bottom wall and three vents 46, 47 and 48 in its side wall. Another vent 50 is placed in the housing side wall at the same level as the vent 48. The vent 48 is normally connected with the basic pipe L. When the piston is pushed down, vent 50 directly overlies vent 47 and connects the by-pass pipe 71 to the air-pipe 78 inside the piston connecting vents 46 with 47.

Inside of the piston, there is another air-pipe 79 forming a part of the basic pipe L and terminating in vents 48 and 49 when the piston 45 is in the position shown in FIG. 5. Air-pipe 79 connects with vent 51, one of the vents in the rotary part, by way of the coupling part 44. The valve housing side wall is equipped with the four levels each having three or four vents which are perpendicular to the axis of the rotary valve part: four vents designated 51, 52, 53 and 54 are on the first level; four vents designated 58, 59, 60 and 61 are on the second level; three vents designated 55, 56 and 57 are on the third level; and three vents designated 62, 63 and 64 are on the fourth level.

The valve rotor has two levels of vents corresponding to those of the valve side wall: on the first level; three vents 51, 53 and 54 correspond to the similarly numbered vents on the valve side wall and on the same level with them, and there is a vent 65 which has no corresponding vent on the valve side wall. On the second level, a vent 57 corresponds to the valve side wall vent 57, and there are vents 66, 67 which have no corresponding vents on the valve housing side wall. With these vents the by-pass pipes and the air-pipes are respectively connected. Namely, the vent 51 of the valve side wall is connected to the basic pipe L. By-pass pipe 68 is connected to vents 52 and 55. By-pass pipe 69 is connected to vents 53 and 56. By-pass pipe 70 is connected to vents 54 and 57.

In the same way, by-pass pipe 71 is connected with vent 58 which is one of the second level vents and vent 50 in the piston part. By-pass pipe 72 is connected with vents 59 and 62. By-pass pipe 73 is connected with vents 60 and 63. By-pass pipe 74 is connected with vents 61 and 64.

Inside of the rotor, the air-pipe 79 is connected with vent 51 to form a part of the basic pipe L and stretches from the piston part by way of the coupling part 44. The air-pipe 75 is connected to vents 65 and 66. The air-pipe 76 is connected with vents 54 and 67. The air-pipe 77 is connected with vents 53 and 57. The distances between the vents 46 and 48 on the piston part, between the vents 51 and 58 of the rotary part, and between the vents 55 and 62 of the rotary part are the same.

In operation, a push of the shaft 80 pushed down not only the upper piston part 45 but also the rotor. The rotor may be independently rotated via bottom shaft 36' by a linkage mechanism similar to that shown in FIG. 3 illustrating the rotary valve of example 1. A spring 81 opposes the push and returns the entire valve mechanism to normal. Moreover, the rotary part of the valve for switchover can be moved in steps each of an angle of 72° without working the piston part of the valve.

In this way, the rotary part can be turned to switch each of the three upper by-pass pipes and the three lower by-pass pipes to connect with the basic pipe L.

The fingering equalizer employed in this example is almost the same as that in example 1; it is different from the latter only in that the tuning key 35 is now directly connected as key 35' with the shaft 80 of the piston part and serves the function of lowering the piston and the rotor. The remaining two keys function in a similar manner, as is clear from FIGS. 8-1 through 8-8.

The air-pipes 75, 76 and 77 can be different in length, but in this example they are made to be same length, i.e., 10 units long when the basic pipe L is 1,000 long. The by-pass pipes 68, 69, 70, 72, 73 and 74 are respectively made to be 49, 53, 57, 65, 69, 74 units long when the basic pipe L is 1,000 units long, and the by-pass pipe 71 is made to be 260 units long including the by-pass pipe 78 forming a part of it.

Figures 1, 2, 8:
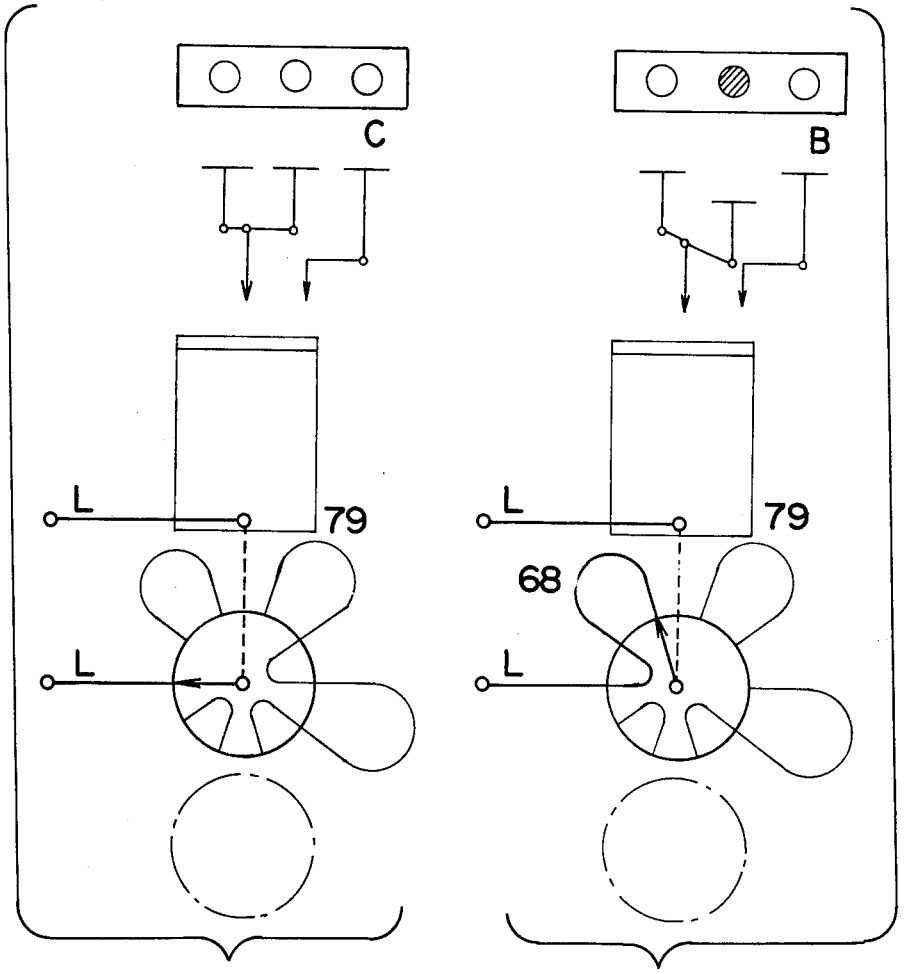
Figures 5, 6, 8:
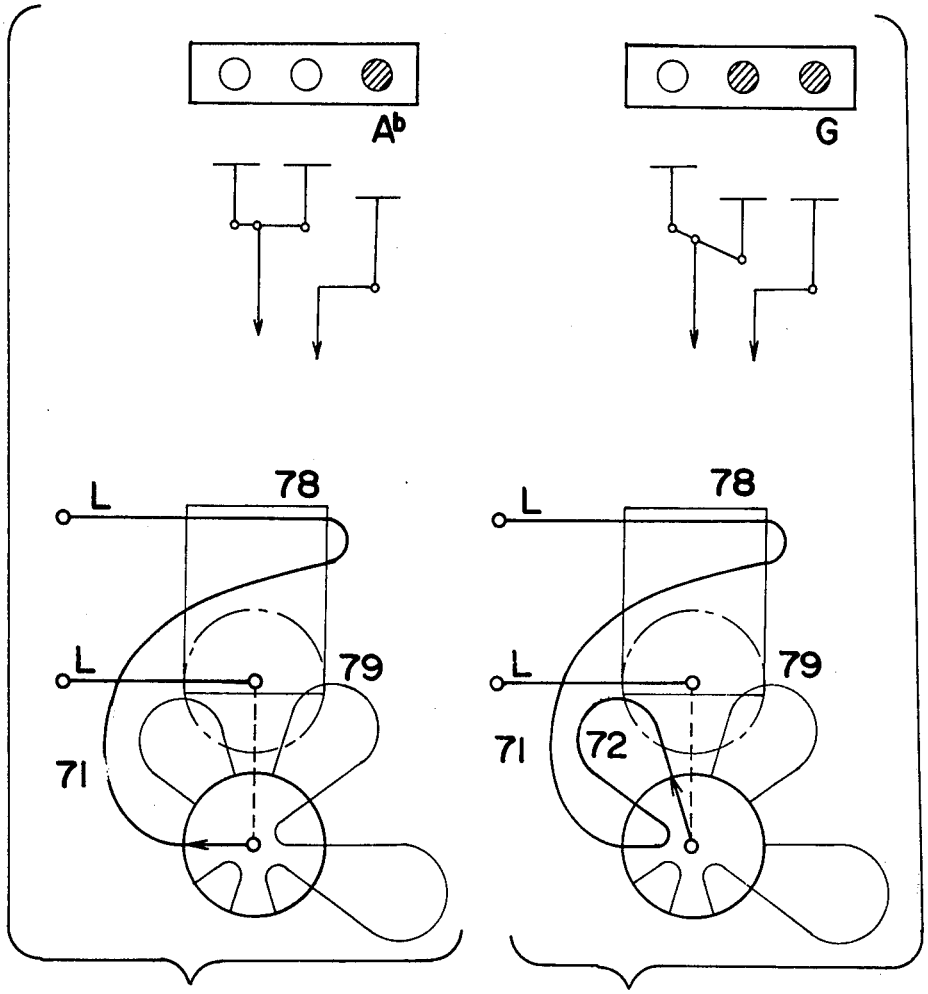
Figures 7, 8:
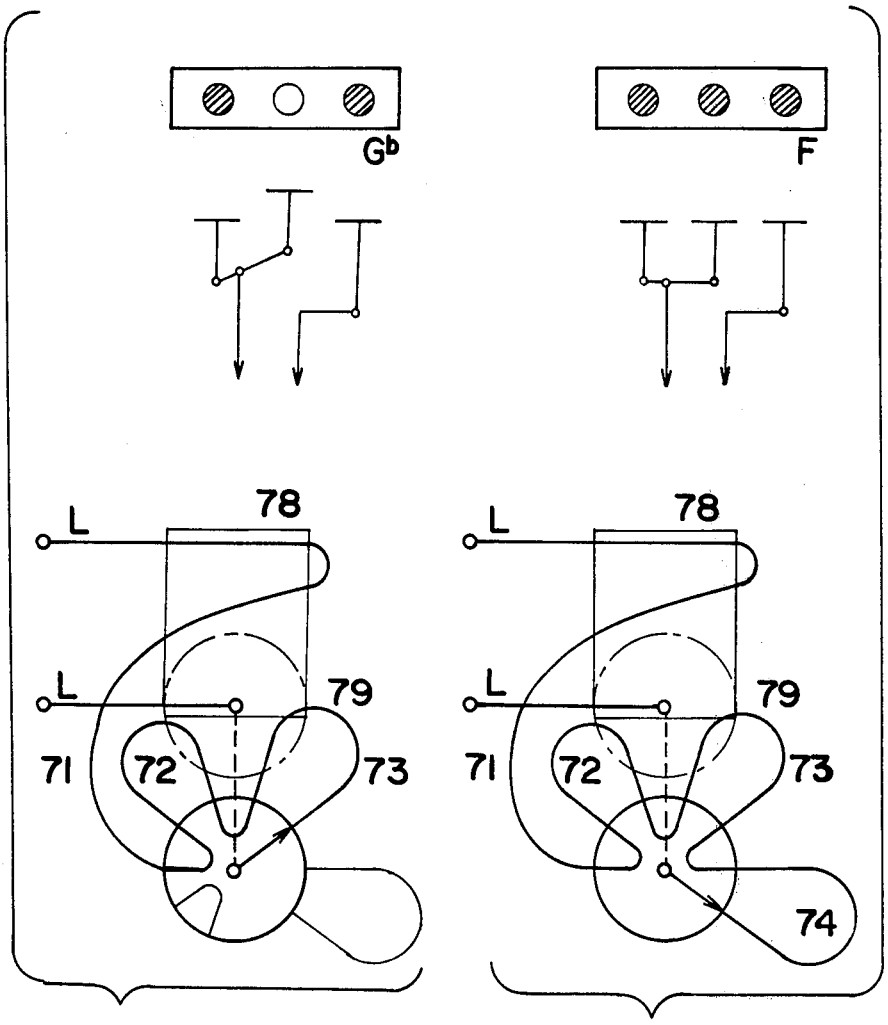

In this example, in the fingering pattern [OOO] where no tuning keys are pushed, air passing through the basic pipe L and the air-pipe 79 forming a part of it as illustrated in FIG. 8-1 causes a C tone. In fingering pattern [O•O] where the second tuning key is pushed to turn the rotary part 72° air passes through L, 79, 68, 75 and L in order as illustrated in FIG. 8-2 to cause a B tone. Similarly as illustrated in FIG. 8-3 and FIG. 8-4, B♭ and A tones are obtained.

In case of the pattern [OO•] where the third tuning key 35' is pushed to lower both the piston and rotary part air passes through L, 78, 71, 79, L in order as illustrated in FIG. 8-5 to achieve an A♭ tone.

In case of the pattern [O••] where not only the third key but also the second key is pushed, the air, passing through L, 78, 71, 75, 72, 79 and L in order as illustrated in FIG. 8-6, causes a G tone. In this case, the rotary part lowers with the piston part and only the rotary part is rotated 72° keeping the piston part at rest by the aid of the coupling part 44.

Similarly as shown in FIG. 8-7 and 8-8, G♭ and F tones can be achieved.

The tones obtained in these ways are shown in Table 3.

| tuning key pattern | tone name | by-pass circuit | ratio of the real length of the whole by-pass circuit | tempera-ment ratio | aber-ration |
|---|---|---|---|---|---|
| O O O | C | (L) | 1000 | 1000 | |
| O ● O | B | 79,68,75 | 1059 | 1059 | O |
| ● O O | B♭ | 79,69,75 68,76 | 1122 | 1122 | O |
| ● ● O | A | 79,70,75, 69,76,68, 77 | 1189 | 1189 | O |
| O O ● | A♭ | 78,71,79 | 1260 | 1260 | O |
| O ● ● | G | 78,71,75, 72,79 | 1335 | 1335 | O |
| ● O ● | G♭ | 78,71,76, 72,75,73, 79 | 1414 | 1414 | O |
| ● ● ● | F | 78,71,77, 72,76,73, 75,74,79 | 1498 | 1498 | O |

Comparing Table 3 with Table 1, it is clear that the defect of the conventional system that the longer the by-pass circuit is, the greater the deviation from the corresponding 12 temperament ratio is overcome. When example 2 is applied to a full double horn it is necessary to switch only one valve instead of the conventional switching of three other valves by an independent valve, so that the complexity in switching operation is avoided, and the device can be very economically fabricated.

Figure 9:
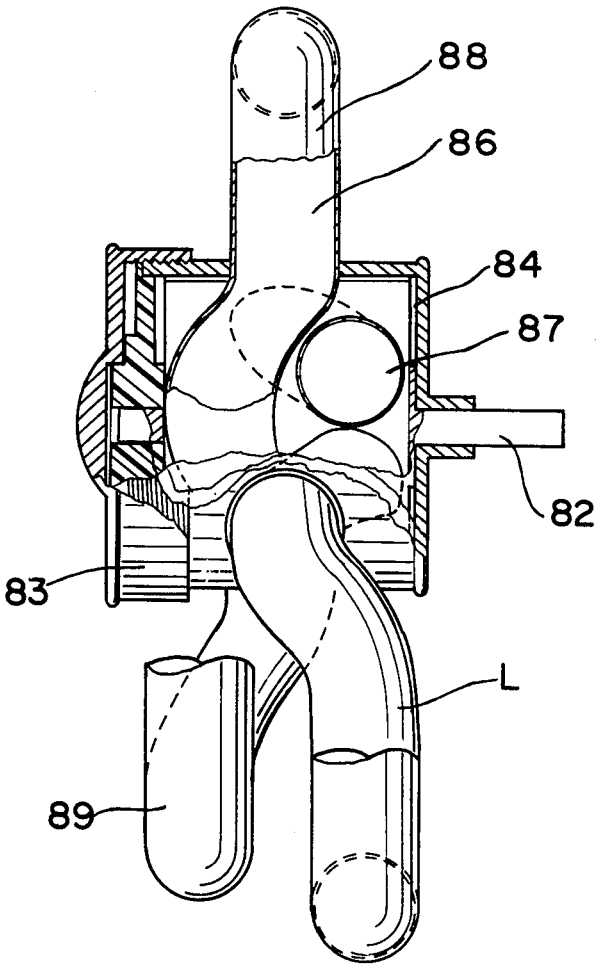
FIG. 9 is a front elevation partially in section of a third rotary valve embodiment according to the invention.
Figure 10:
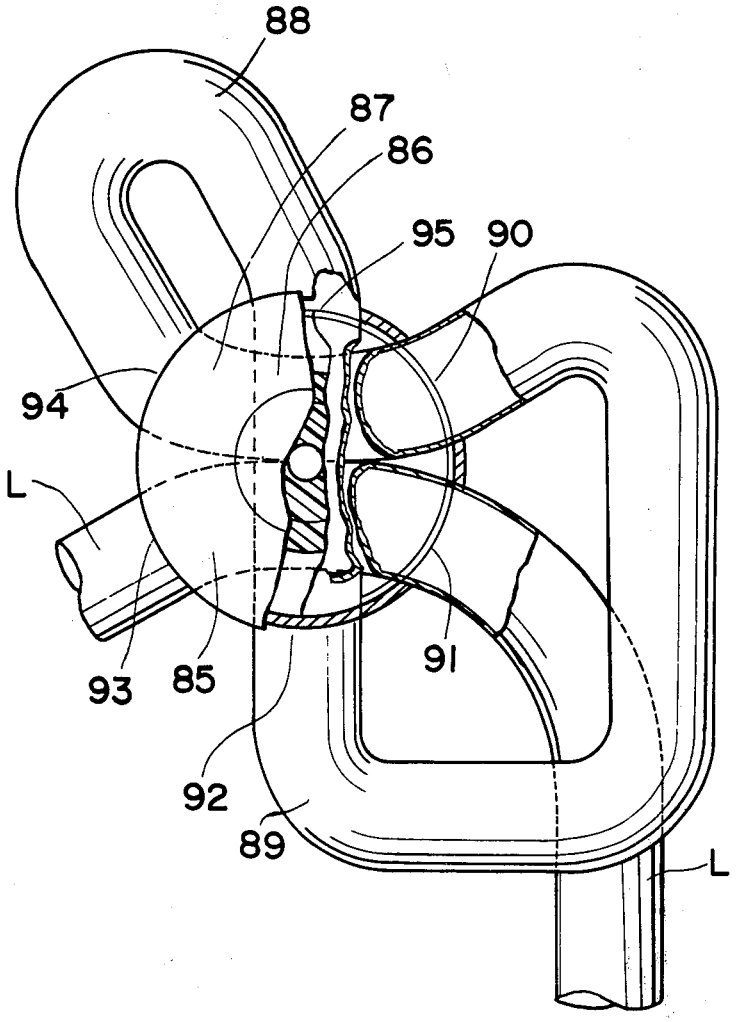
FIG. 10 is a bottom plan view partially in section of the valve of FIG. 9.

FIGS. 9 to 11-3 show example 3 where a rotary valve with two by-pass pipes and three air-pipes inside the rotor enable the by-pass pipes to connect with the basic pipe L. Sixty degree angle changing rotation is employed. The valve employed in this example is shown in FIG. 9 and FIG. 10. In the Figures: 82 designates a rotor shaft; 83 a valve cover; 84 a ring made of Teflon; the three air-pipes 85, 86 and 87 are inside the rotor; 88 and 89 are the two by-pass pipes; and 90, 91, 92, 93, 94 and 95 are the six vents formed in the valve housing side wall. These vents are placed on the same level of the housing wall; the basic pipe L and the by-pass pipes 88 and 89 are connected to them. Here the three air-pipes 85, 86 and 87 are the same in length, each forming a part of the basic pipe L and the by-pass pipes 88 and 89 when they are switched.

Figures 1, 11:
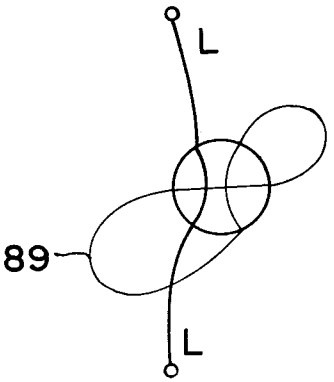
Figures 2, 11:
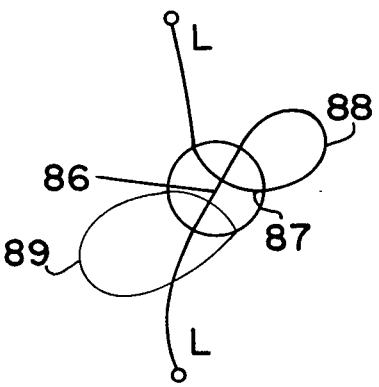
Figures 3, 11:
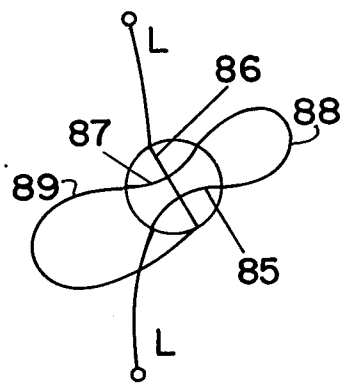

FIGS. 11-1 is a diagram of the pipe circuit showing the valve unturned and the air passes through only the basic pipe L, where the air-pipe 85 forms a part of the basic pipe.

FIG. 11-2 is a diagram of the circuit showing the valve turned 60°. Here the blow passes through the basic pipe L, the air-pipe 87, the by-pass pipe 88, the air-pipe 86 and the basic pipe L in order.

FIG. 11-3 is a diagram of the circuit showing the valve turned 120°. The blow passes through the basic pipe L, the air-pipe 86, the by-pass pipe 89, the air-pipe 87, the by-pass pipe 88, the air-pipe 85 and the basic pipe L.

In this case, the by-pass pipe 88 and one of the air-pipes are 335 units long in all, and the by-pass pipe 89 and one of the air-pipes are 553 units long in all, when the basic pipe and one of the air-pipes illustrated in FIG. 11-1 are 1,000 unit long in all. The circuits illustrated in FIG. 11-2 and FIG. 11-3 are respectively 1335 and 1888 units long, so that if this valve is applied to a trombone such as presently employs two valves, it not only reduces the number of valves from two to one, but also make the tones from G to D♭ coincide with those in temperament.

FIGS. 12 to 14-3 illustrate example 4 by means of a rotary valve in which on the upper level the second conventional by-pass pipe $l_2$ attached to the first valve and the first by-pass pipe $l_1$ attached to the second valve are characteristically lengthened and, at the same time, on the lower level the third by-pass pipe $l_3$ and fourth by-pass pipe $l_4$ which are unique to this valve are characteristically switched to connect with the basic pipe L when the rotor turns.

Figure 13:
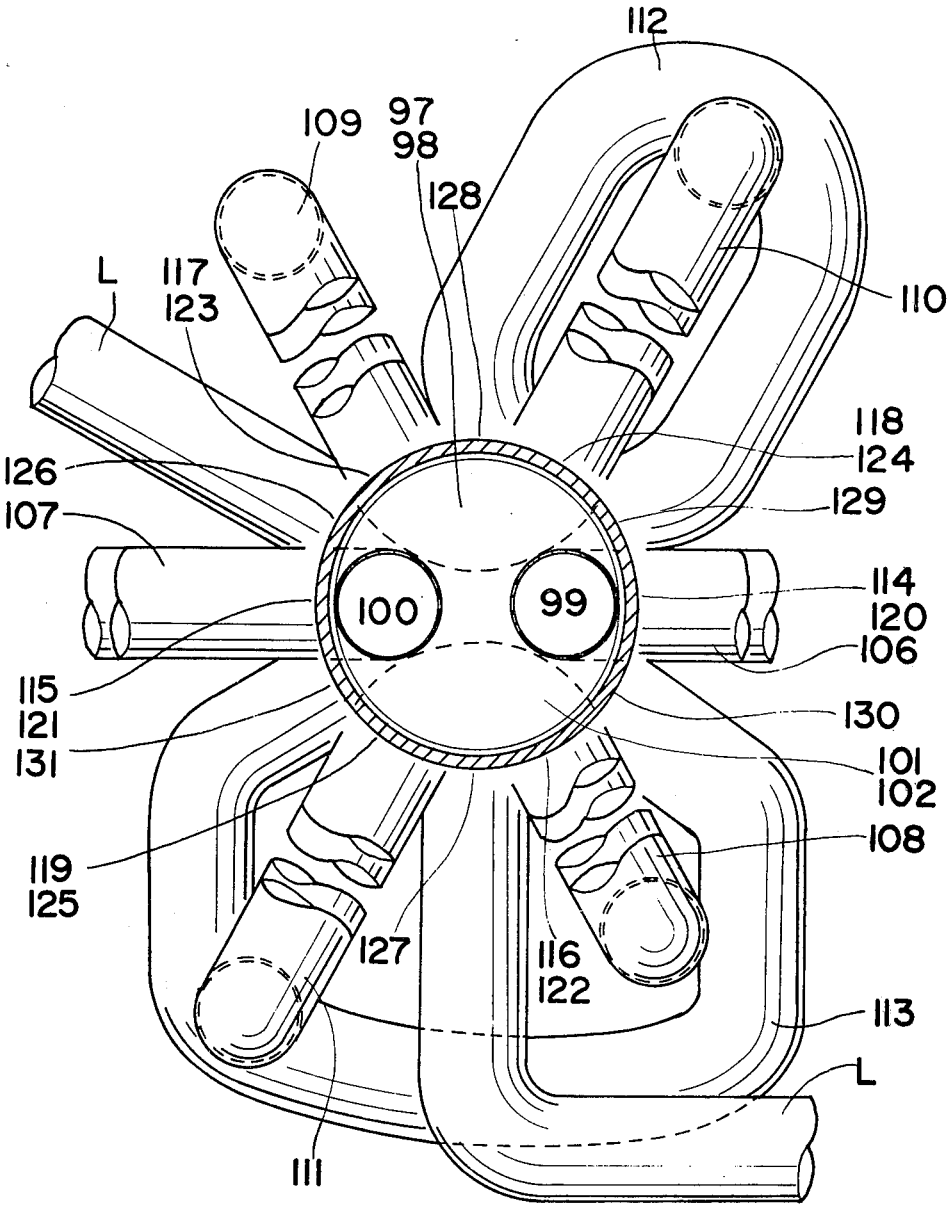
FIG. 13 is a plan view partially in section of the rotary valve taken from line A-A′ of FIG. 12.

The valve employed in example 4 is illustrated in FIG. 12 and FIG. 13, where 96 designates a rotor shaft and 97, 98, 99, 100, 101 and 102 designate six air-pipes formed in the upper part of the valve, passing through the rotor, which are employed when the by-pass pipes 106, 107, 108, 109, 110 and 111 are switched to connect. Three air pipes, designated 103, 104 and 105, (shown schematically in FIG. 14-3) pass through the rotor in a lower part of the valve and are employed when the by-pass pipes 112 and 113 are switched to connect. Air pipes 103, 104 and 105 are analogous in form and in function to air pipes 85, 86 and 87 of example 3 explained hereinabove, while by-pass pipes 112 and 113 are analogous to by-pass pipes 88 and 89 of example 3.

The valve is on its upper part equipped with two parallel levels of six vents each which are switched to connect with vents in the valve housing side wall when the rotor is turned in angled steps of 60°. The six vents 114, 115, 116, 117, 118 and 119 are the upper ones placed on the same level, while the six vents 120, 121, 122, 123, 124 and 125 are the lower ones placed on the same level.

Among the air-pipes passing through the rotor, 99 and 100 each connect the upper vents with the corresponding aligned lower vents, 97 and 101 couple the adjacent neighbor upper vents and 98 and 102 couple the adjacent lower vents.

Vents on the valve housing side wall connect to the six by-pass pipes 106, 107, 108, 109, 110 and 111, each pipe connecting the upper vent to the corresponding aligned lower vents.

The valve on its lower part like on its upper part is equipped with the six vents 126, 127, 128, 129, 130 and 131 placed on the same level. These vents are switch connected when the rotor is turned every 60°. The three air-pipes, 103, 104 and 105 passing through the lower part of the rotor are connected with these vents and with the basic pipe L and the by-pass pipes 112 and 113 just as in the valve shown in example 3.

FIGS. 14-1 and 14-3 are the diagrams of the circuits obtained when a valve according to example 4 is employed. Existing conventional valves can be used as the first and the second valves, the first by-pass pipe $l_1$ of the latter valve and the second by-pass pipe $l_2$, with the by-pass pipes 106, 107 and the air-pipes 99, 100 each forming a part of $l_1$ and $l_2$.

FIG. 14-3 is a diagram showing the example 4 valve unturned. On the upper part of the valve the air-pipes 99 and 100, each connect with the by-pass pipes 106 and 107, to correspond to $l_1$ and $l_2$ of Table 1. On the lower part of the valve the air-pipe 103, connecting with the basic pipe L, forms a part of the basic pipe L. Here it goes without saying that $l_1$ and $l_2$ are connected with the basic pipe L when the conventional first or second valve is turned singly or they are turned together.

FIG. 14-1 is the diagram of the circuit in the case of the example 4 valve being turned 60°, where on the upper part of the valve the by-pass pipe 106 is connected with 108 by way of the air-pipes 101 and 102, the by-pass 107 is connected with 109 by way of the air-pipes 97 and 98 and on the lower part of the valve the by-pass pipe 112 is connected with the basic pipe L by way of the air-pipes 104 and 105. Therefore in this case, as the by-pass pipe 112 and the air-pipe 104 are connected with the basic pipe L, even when the first or second valve, is not turned, the whole circuit is longer and when the first or the second valve is turned, the whole circuit is much longer because the air-pipes 101 and 102 and the by-pass pipe 108 are connected with 106 and the air-pipes 97, 98 and the by-pass pipe 109 are connected with 107.

FIG. 14-2 is a diagram of the circuit in the case of the example 4 valve being turned 120°, where in the upper part 106 is connected with 110 by 101 and 102 and 107 is connected with 111 by 97 and 98 and on the lower part the by-pass pipes 112 and 113 are connected with the basic pipe L by the air-pipes 103, 104, and 105. Therefore in this case, even when the first and the second valve are not turned, the whole by-pass circuit is longer because the by-pass pipes 112 and 113 and the air-pipes 104 and 105 are connected with the basic pipe L, and moreover when the first and the second valves are turned the whole by-pass circuit is much longer because the air-pipes 101, 102 and the by-pass pipe 110 are connected with 106 and the air-pipes 97 and 98 and the by-pass pipe 111 are connected with 107.

The air-pipes 97, 98, 99, 100, 101 and 102 can be different in length but in this example they are made of the same length. They are six units long supposing the basic pipe L is 1,000 units long, and the by-pass pipes 106, 107,

108, 109, 110, 111 are made 53, 116, 10, 26, 32 and 70 units long respectively. The combination of one of the by-pass pipes 112 and 113 and one of the air-pipes 103, 104 and 105 are made 260 and 327 units long respectively. Moreover, if the by-pass $l_{12}$ is made eight units long, is connected with the first or the second valve which compensates the first and the second by-pass circuits only when the first and the second valves are turned together, in this example, the fingering patterns are almost the same as in the conventional four valve system, and what is better, tones almost coming up to the ratio of temperament can be attained.

The relation between the tuning patterns and the corresponding tones for the example 4 valve is shown in Table 4, where the valve turns 60° when the third key is pushed and the valve turns 120° when the fourth key is pushed: therefore in this case, the pushing of the fourth key has the same effect whether the third key is pushed or not.

| existing valve device | | | | this example | | | |
|---|---|---|---|---|---|---|---|
| tuning key pattern | tone name | tuning key pattern | tone name | by-pass circuit | ratio of the real length of the whole by-pass circuit | temperament ratio | aberration |
| O O O O | C | O O O O | C | (L) | 1000 | 1000 | |
| O ● O O | B | O ● O O | B | 106,99 | 1059 | 1059 | 0 |
| ● O O O | B♭ | ● O O O | B♭ | 107,100 | 1122 | 1122 | 0 |
| ● ● O O<br>O O ● O | A | ● ● O O | A | 106,99,107,100, $l_{12}$ | 1189 | 1189 | 0 |
| O ● ● O | A♭ | O O ● O | A♭ | 112,104 | 1260 | 1260 | 0 |
| ● O ● O<br>O O O ● | G | O ● ● O | G | 106,101,102,108, 112,104 | 1335 | 1335 | 0 |
| ● O O ● | F | ● ● ● O | F | 106,101,102,108, 107,97,98,109, 112,104,$l_{12}$ | 1497 | 1498 | −1 |
| ● ● O ●<br>O O ● ● | E | O O ● ● | E | 112,113,103,105 | 1587 | 1587 | 0 |
| O ● ● ● | E♭ | O ● ● ● | E♭ | 106,101,102,110, 112,113,104,105 | 1684 | 1682 | +2 |
| ● O ● ● | D | ● O ● ● | D | 107,97,98,111, 112,113,104,105 | 1785 | 1782 | +3 |
| ● ● ● ● | D♭ | ● ● ● ● | D♭ | 106,101,102,110, 107,97,98,110, 112,113,104,105,$l_{12}$ | 1890 | 1888 | +2 |

As clearly explained in the above four examples, the valve tuning device according to this invention characteristically has a valve: which is able to switch in more than one way; by the switchover of which more than one by-pass pipes which are controlled by this valve independently are to be switched to connect with the basic pipe L; does not change the existing tuning key patterns; and, what is better, perfectly removes the effect of the conventional device that the longer the by-pass circuit is, the greater is the aberration from the 12 temperament.

Therefore it is quite clear that this invention can succeed in attaining its purpose by the switching-connection of more than one by-pass pipes by means of the switchover of the valve itself without the help of the conventional independent valves.

What is claimed is:

1. A valve tuning system for brass musical instruments comprising a single valve housing, a valve body movable in said housing, a basic instrument pipe and a plurality of by-pass pipes connected to the housing, a plurality of air passages formed in the valve body, tuning means which comprises a plurality of separately actuable finger keys, and means connecting said tuning means to said valve body operable to move the valve body to a plurality of switchover positions such that various combinations of the by-pass pipes and air passages may be connected in series with the basic instrument pipe.

2. The valve tuning system as set forth in claim 1 wherein the lengths of each of said by-pass pipes, said air passages and said basic instrument pipe are selected to provide a temperament ratio with substantially zero aberrations.

3. A valve tuning system according to claim 1 wherein said valve body is formed with six air passages therein and is rotatable in said valve housing, there being six by-pass pipes and the basic pipe connected to the valve housing, and said means for moving the valve body is operable to turn the valve body to seven switchover positions.

4. The valve tuning system as set forth in claim 1 wherein each of said by-pass pipes connected to said housing is of a fixed, non-adjustable length.

5. The valve tuning system as set forth in claim 1 wherein said valve body includes a rotor shaft axially formed thereon and wherein said finger keys are actuable in a direction transverse to the axis of said rotor shaft so as to cause rotation thereof.

6. The valve tuning system as set forth in claim 5 wherein said means connecting said tuning means to said valve body comprises linkage means interconnecting said finger keys and an actuating arm coupled between said linkage means and said rotor shaft for rotating said shaft a predetermined amount in response to the actuation of one or more of said finger keys.

7. The valve tuning system as set forth in claim 6 wherein said finger keys are three in number, the first and second keys connected by a first pivotable link, the third key connected to said first pivotable link by a second pivotable link, said actuating arm being pivotally connected to said second link.

8. The valve tuning system as set forth in claim 7 wherein each of said by-pass pipes connected to said housing is of a fixed, non-adjustable length.

9. A valve tuning system for brass musical instruments, which comprises:

a valve housing;

a valve body movable in said housing;

a basic instrument pipe and at least three by-pass pipes connected to said housing, each of said by-pass pipes being of a fixed predetermined non-adjustable length;

a plurality of air passages formed in said valve body;

manually operable means for tuning said instrument; and means connecting said tuning means to said valve body for moving same to one selectable position from a plurality of switchover positions each of which defines a particular series connection between said by-pass pipes, said air passages and said basic instrument pipe.

10. The valve tuning system as set forth in claim 9 wherein said tuning means comprises a plurality of separately actuable finger keys.

11. The valve tuning system as set forth in claim 9 wherein said valve body includes a rotor shaft axially formed thereon and wherein said tuning means includes an actuating arm movable in a direction transverse to the axis of said rotor shaft so as to cause rotation thereof.

12. The valve tuning system as set forth in claim 9 wherein the lengths of each of said by-pass pipes, said air passages and said basic instrument pipe are selected to provide a temperament ratio with substantially zero aberrations.

* * * * *